United States Patent [19]

Woolhouse

[11] Patent Number: 4,464,243

[45] Date of Patent: Aug. 7, 1984

[54] ELECTRODE FOR USE IN ELECTROLYTIC CELL

[75] Inventor: Robin A. Woolhouse, Bunsbury, Nr Tarporley, England

[73] Assignee: Imperial Chemical Industries Limited, London, England

[21] Appl. No.: 284,946

[22] Filed: Jul. 20, 1981

[30] Foreign Application Priority Data

Jul. 30, 1980 [GB] United Kingdom ..... 8024922
Sep. 18, 1980 [GB] United Kingdom ..... 8030230

[51] Int. Cl.[3] ..... C25B 9/00; C25B 11/02; C25B 11/10

[52] U.S. Cl. ..... 204/257; 204/269; 204/284; 204/288; 204/290 F

[58] Field of Search ..... 204/288–289, 204/279, 290 R, 290 F, 284, 257–258, 253–256, 252, 283, 269–270

[56] References Cited

U.S. PATENT DOCUMENTS 857,910 6/1907 Tate ..... 204/288 X
961,549 6/1910 Sperry ..... 204/284
1,448,208 3/1923 Gerstle ..... 204/288 X
1,907,812 5/1933 Honsberg ..... 204/252
3,992,279 11/1976 Larsson ..... 204/288
4,013,525 3/1977 Emsley ..... 204/290 F X
4,060,475 11/1977 Fournier et al. ..... 204/289 X
4,124,479 11/1978 Boulton ..... 204/256
4,126,534 11/1978 Boulton ..... 204/288 X
4,154,665 5/1979 Boulton ..... 204/253
4,204,939 5/1980 Boulton et al. ..... 204/258
4,252,628 2/1981 Boulton et al. ..... 204/257
4,255,246 3/1981 Davis et al. ..... 204/288 X

FOREIGN PATENT DOCUMENTS 2845832 5/1979 Fed. Rep. of Germany .
2406674 5/1979 France .
668618 10/1949 United Kingdom .
1324427 7/1973 United Kingdom .

*Primary Examiner*—Donald R. Valentine
*Attorney, Agent, or Firm*—Cushman, Darby & Cushman

[57] ABSTRACT

An electrode, suitable for use in an electrolytic cell of the filter-press type, and comprising a substantially planar support member and on at least one face of the support member, and preferably on both faces, a plurality of elongated members, for example strips, substantially parallel to each other and each attached at both ends to the support member, a substantial part of the elongated members lying in a plane displaced from and substantially parallel to the support member and the faces of the elongated members lying in planes substantially parallel to the plane of the support member. Also an electrolytic cell, incorporating the electrode.

20 Claims, 6 Drawing Figures

ELECTRODE FOR USE IN ELECTROLYTIC CELL

Figure 1:
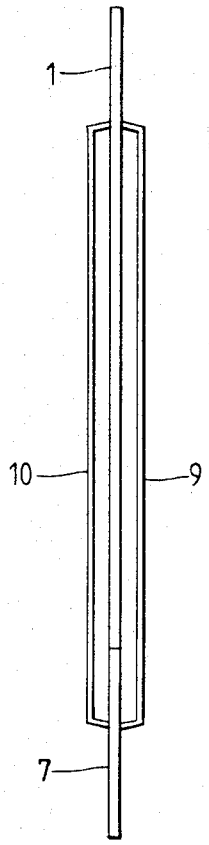

This invention relates to an electrode for use in an electrolytic cell.

Electrolytic cells are known comprising a plurality of anodes and cathodes with each anode being separated from the adjacent cathode by a separator which divides the electrolytic cell into a plurality of anode and cathode compartments. The anode compartments of such a cell are provided with means for feeding electrolyte to the cell, suitably from a common header, and with means for removing products of electrolysis from the cell. Similarly, the cathode compartments of the cell are provided with means for removing products of electrolysis from the cell, and optionally with means for feeding water or other fluid to the cell.

Electrolytic cells of the filter press type may comprise a large number of alternating anodes and cathodes, for example, fifty anodes alternating with fifty cathodes, although the cell may comprise even more anodes and cathodes, for example up to one hundred and fifty alternating anodes and cathodes.

The electrolytic cell may be of the diaphragm or membrane type. In the diaphragm type cell the separators positioned between adjacent anodes and cathodes are microporous and in use the electrolyte passes through the diaphragms from the anode compartments to the cathode compartments of the cell. In the membrane type cell the separators are essentially hydraulically impermeable and in use ionic species are transported across the membranes between the anode compartments and the cathode compartments of the cell.

Electrolytic cells of the aforementioned types may be used in the electrolysis of aqueous alkali metal chloride solutions. Where such a solution is electrolysed in an electrolytic cell of the diaphragm type the solution is fed to the anode compartments of the cell, chlorine which is produced in the electrolysis is removed from the anode compartments of the cell, the alkali metal chloride solution passes through the diaphragms and hydrogen and alkali metal hydroxide produced by electrolysis are removed from the cathode compartments, the alkali metal hydroxide being removed in the form of an aqueous solution of alkali metal chloride and alkali metal hydroxide. Where an aqueous alkali metal chloride solution is electrolysed in an electrolytic cell of the membrane type the solution is fed to the anode compartments of the cell and chlorine produced in the electrolysis and depleted alkali metal chloride solution are removed from the anode compartments, alkali metal ions are transported across the membranes to the cathode compartments of the cell to which water or dilute alkali metal hydroxide solution may be fed, and hydrogen and alkali metal hydroxide solution produced by the reaction of alkali metal ions with water are removed from the cathode compartments of the cell.

Electrolytic cells of the type described may be used particularly in the production of chlorine and sodium hydroxide by the electrolysis of aqueous sodium chloride solution.

Electrolytic cells as hereinbefore described, and in particular electrolytic cells of the filter press type, may comprise electrodes, that is anodes and/or cathodes, which consist of a support member and a plurality of upstanding elongated members on the support member which are generally vertically disposed and parallel to each other. For example, the electrodes may be so-called louvred electrodes which may be produced, for example, by forming in a metal sheet a plurality of substantially parallel slits and folding segments of metal away from the plane of the sheet to form a plurality of upstanding substantially parallel elongated members, that is the so-called louvres. The louvres may be disposed at right angles to the plane of the sheet or at an angle of less than 90° to the plane of the sheet, for example at an angle of approximately 60°. Electrolytic cells containing louvred electrodes are described, for example, in Belgian Pat. Nos. 864363 and 864364.

Electrolytic cells, for example electrolytic cells of the filter press type, are desirably operated at as low an anode-cathode gap as possible in order that the electrical resistance in the cells, and thus the voltage at which the cells are operated, may be as low as possible. In order to provide a low anode-cathode gap the separators are positioned close to the anode and cathode, and may be in contact with the anode and cathode adjacent thereto in which case the anode-cathode gap is effectively the same as the thickness of the separator.

Positioning the separator in contact with the anode and cathode adjacent thereto also has the advantage that the anode and cathode provide a support for the separator. However, there may be an associated disadvantage which is particularly apparent in filter press cells where the electrodes comprise a plurality of upstanding elongated members, especially upstanding louvres. Thus, where the electrode comprises a plurality of upstanding elongated members, and in particular where the separator is in contact with upstanding members, there may be poor circulation of liquor in the compartments of the cell, and in particular across the cell, circulation of liquor, especially across the cell, being hindered by the upstanding members. This poor circulation is particularly apparent where the means for feeding liquors to the cell and the means for removing the products of electrolysis from the cell are situated at the sides of the cell. The poor circulation of liquors in the compartments of the cell manifests itself in poor disengagement of gaseous products of electrolysis from the liquors in the cell and concentration gradients in the liquors which result in a higher voltage of operation at a given current density than would otherwise be expected.

The present invention provides an electrode, which is particularly suitable for use in an electrolytic cell of the filter press type, and which permits greatly improved circulation of the liquors in the compartments of the cell.

The present invention provides an electrode, suitable for use in an electrolytic cell of the filter press type, the electrode comprising a substantially planar support member and, on at least one face of the support member, a plurality of elongated members substantially parallel to each other and each attached at at least the ends thereof to the support member, a substantial part of the elongated members lying in a plane displaced from and substantially parallel to the plane of the support member and the elongated members presenting faces lying in a plane substantially parallel to the plane of the support member.

The elongated members may be and are preferably in the form of strips, and in a further embodiment of the invention there is provided an electrode comprising a substantially planar support member and, on at least one face of the support member, a plurality of strips substantially parallel to each other and each attached at the ends thereof to the support member, a substantial part of the strips lying in a plane displaced from and substantially parallel to the plane of the support member and the strips presenting faces lying in a plane substantially parallel to the plane of the support member.

The electrode may be used as an anode and/or a cathode, and the invention also provides an electrolytic cell comprising a plurality of anodes and cathodes in which a separator is positioned between adjacent anodes and cathodes, the anodes or cathodes, or both, comprising electrodes as herein described.

Unless otherwise stated the invention will be described hereafter by reference to electrodes in which the elongated members are in the form of strips.

The electrodes, and particularly the support member part of the electrode, are desirably flexible, and preferably resilient, as flexibility and resiliency aids in the achievement of fluid-tight seals when the electrodes are assembled into an electrolytic cell, particularly a cell of the filter press type.

Where, in the electrolytic cell, the separator is in contact with the faces of the strips on the electrode circulation of liquors in the cell, and particularly across the cell, will not be inhibited by the strips as the strips are displaced from the plane of the support member and there is thus provided across the cell a channel between the support member and the strips through which liquor may circulate.

In the electrode the strips may be positioned on one face only of the support member, especially where the electrode is to be used as a terminal electrode in an electrolytic cell. Alternatively, the strips may be positioned on both faces of the support member, especially where the electrode is to be used as an internal electrode in an electrolytic cell, particularly in an electrolytic cell of the filter press type.

When the electrode is installed in an electrolytic cell the electrode will generally be so positioned that the strips are substantially vertical. However, vertical positioning of the strips is not essential and, if desired the strips, which are substantially parallel to each other, may be inclined at an angle to the vertical. The strips on an electrode to be used as an anode may be inclined at an angle to the vertical which is in a direction opposite to that at which the strips on an electrode to be used as a cathode are inclined. In this way additional support for the separator will be provided.

Where the electrode comprises strips positioned on both faces of the support member the strips on one face may be positioned opposite to the strips on the other face of the support member. Alternatively, the strips may be staggered such that a strip on one face of the support member is positioned opposite to a space between two adjacent strips on the other face of the support member.

In order to ensure that the strips maintain their position relative to the support member, and thus provide support for a separator which in the electrolytic cell may be in contact with the strips, the strips are attached at both ends to the support member.

The support member may be rectangular in shape, and may be for example square-or oblong-shaped. The support member may be a substantially planar sheet with the ends of each of the strips attached to the sheet near to opposite edges of the sheet.

The support member may be in the form of a substantially planar frame which may be rectangular in shape, for example square-or oblong-shaped. One end of each of the strips may be attached near to one edge of the frame and the other end of each of the strips may be attached to the frame near to an opposite edge of the frame. This embodiment in which the support member is in the form of a frame is a preferred embodiment as circulation of liquors in the compartments of an electrolytic cell in which the electrode is installed is further assisted by the use of this particular type of electrode.

The electrode of the present invention possesses a further advantage over the louvred type of electrode. In a louvred electrode the edges of the louvres, which in the electrolytic cell may be in contact with the separator, are often not smooth and, by virtue of the method of manufacture, may even possess sharp edges which can result in damage to the separator and even to the formation of holes in the separator. On the other hand, in the electrode of the present invention the faces of the elongated members, e.g. the strips, lie in a plane substantially parallel to the plane of the support member and in the electrolytic cell it is the faces of the elongated members, e.g. the strips, and not the edges thereof, which contact the separator. As the faces contact the separator there is a much reduced possibility of the elongated members damaging the separator.

The faces of the elongated members may be planar but it is preferred, in order to reduce even further the risk of damage to the separator, that the transverse faces of the elongated members are slightly curved. Thus, where the elongated members are strips the transverse faces of the strips on the side facing away from the support member are preferably slightly convex so that in the electrolytic cell a convex face of the strip is presented to and may be contacted with the separator.

In the electrode of the invention a substantial part of each of the strips lies in a plane displaced from and substantially parallel to the plane of the support member. It is desirable that as much as possible of each of the strips be in a plane substantially parallel to the plane of support member but clearly as the strips are attached at the ends thereof to the support member the whole of the length of the strips cannot be in such a plane. It is preferred that at least 50% of the length of the strips, and more preferably at least 80% of the length of the strips, be in a plane displaced from and substantially parallel to the plane of the support member. As much as 95% of the length of the strips may be in such a plane.

The electrode preferably has a dimension in the direction of current flow which is in the range 15 to 60 cm in order to provide in the electrode short current paths which in turn ensure low voltage drops in the electrode when installed in an electrolytic cell without the use of elaborate current carrying devices.

The distance by which the plane of the strips is displaced from the plane of the support member governs the dimensions of the channel between the plane of the support member and the plane of the strips through which liquor may circulate in the cell. This distance will depend inter alia on the overall dimensions desired in the electrode, particularly the desired width of the electrode, and on the overall dimensions desired in the electrolytic cell, but it will generally be at least 1 mm, and is preferably at least 2 mm. It may be as much as 10 mm or even greater, e.g. up to 20 mm. Where the distance by which the plane of the strips is displaced from the plane of the support member is small the release of gas produced in the electrolysis may not be sufficiently rapid and there may be an adverse effect on the voltage of the electrolysis. It is also desirable to conduct the electrolysis at high current efficiency and the aforementioned distance is desirably set so as to optimise the current efficiency and voltage.

Where the electrodes of the invention are assembled into an electrolytic cell as both anodes and cathodes the distance by which the plane of the strips is displaced from the plane of the support member may be the same in the anode as in the cathode, or this distance in the anode may be different from the corresponding distance in the cathode.

The faces of the strips are desirably at least 1 mm wide, and are preferably at least 2 mm wide, so that a reasonably substantial width of face is presented to the separator when the electrode is installed in an electrolytic cell. In general the width of the strips will not be greater than 10 mm, although it is possible to use strips of widths greater than 10 mm.

The distance between adjacent strips on a face of the electrode is desirably at least 1 mm, and is preferably at least 2 mm. In general this distance will not be greater than 10 mm, although it may be if desired.

The strips on a face of the electrode are separated from each other and the gaps between adjacent strips provide spaces into which the diaphragm or membrane may be accommodated should the diaphragm or membrane swell when used in an electrolytic cell. Cation-exchange membranes are particularly susceptible to swelling and the electrode of the invention provides a means of accommodating the swelling in a controlled manner.

The electrode of the invention will generally be made of a metal or alloy and in use it may act as an anode or a cathode. The nature of the metal will depend on whether the electrode is to be used as an anode or cathode and on the nature of the electrolyte which is to be electrolysed in the electrolytic cell.

Where aqueous alkali metal chloride solution is to be electrolysed and the electrode is to be used as an anode the electrode is suitably made of a film-forming metal or an alloy thereof, for example of zirconium, niobium, tungsten or tantalum, but preferably of titanium, and the surface of the anode suitably carries a coating of an electro-conducting electrocatalytically active material. The coating may comprise one or more platinum group metals, that is platinum, rhodium, iridium, ruthenium, osmium or palladium, and/or an oxide of one or more of these metals. The coating of platinum group metal and/or oxide may be present in admixture with one or more non-noble metal oxides, particularly one or more film-forming metal oxides, e.g. titanium dioxide. Electro-conducting electrocatalytically active materials for use as anode coatings in an electrolytic cell for the electrolysis of aqueous alkali metal chloride solution, and methods of application of such coatings, are well known in the art. The coating is suitably applied at least to the strips on the anode, especially to the faces of the strips. The coating may be applied to the reverse side of the strips, that is to the sides facing the support member, and also to the edges of the strips.

Where aqueous alkali metal chloride solution is to be electrolysed and the electrode is to be used as a cathode the electrode is suitably made of iron or steel, or of other suitable metal, for example nickel. The cathode, particularly the strips thereof, may be coated with a material designed to reduce the hydrogen overpotential of the electrolysis.

The electrode of the present invention may be a bipolar electrode. Thus, the electrode may comprise a first metal sheet and a second metal sheet electrically conductively connected thereto, at least one of the sheets, and preferably both of the sheets, having attached thereto a plurality elongated members, e.g strips, as hereinbefore described. For example, where the bipolar electrode is to be used in an electrolytic cell wherein an aqueous alkali metal chloride solution is to be electrolysed the first sheet, and the strips attached thereto, may be made of a film-forming metal or alloy and may function as an anode, and the second sheet, and the strips attached thereto, may be made of iron or steel, or other suitable metal, for example nickel, and may function as a cathode.

In a modification of the electrode of the invention a foraminate metallic sheet material is attached to the faces of the elongated members of the electrode, on one or on both sides thereof. The foraminate sheet material, which is in electrical contact with the elongated members, for example, by welding thereto, may be, for example, a woven sheet, a perforated sheet, or a sheet of expanded metal.

The electrode of the invention may be made by attaching the elongated members, e.g. the strips, to the support member, for example by welding or brazing the strips to the support member, or by the use of any technique which will result in an electrically conductive bond between the strips and the support member. A preferred method of manufacture of the electrode, on account of its simplicity of operation, is to form a plurality of substantially parallel slits in a planar support member, by use of a suitable slitting tool, and to displace a substantial proportion of the strips defined in the support member by the slits into a plane displaced from the plane of the support member and substantially parallel thereto. The slits may traverse the support member from a position near one edge of the support member to a position near an opposite edge of the support member, and the act of displacing a substantial proportion of the strips to a plane displaced from the plane of the support member should not of course result in the strips becoming detached from the support member. Where both sides of the support member are to have strips attached thereto some of the strips defined by the slits in the support member may be displaced to one side of the support member and some of the strips may be displaced to the other side of the support member. For example, the strips defined by the slits in the support member may be displaced alternately to one side of the support member and then to the other side, in which case a strip on one side of the electrode will be positioned opposite to a space between two adjacent strips on the other side of the support member.

The electrolytic cell in which the electrode of the invention is installed may be of the diaphragm or membrane type. In the diaphragm type cell the separators positioned between adjacent anodes and cathodes to form separate anode compartments and cathode compartments are microporous and in use the electrolyte passes through the diaphragms from the anode compartments to the cathode compartments. Thus, in the case where aqueous alkali metal chloride solution is electrolysed the cell liquor which is produced comprises an aqueous solution of alkali metal chloride and alkali metal hydroxide. In the membrane type electrolytic cell the separators are essentially hydraulically impermeable and in use ionic species are transported across the membranes between the compartments of the cell. Thus, where the membrane is a cation-exchange membrane cations are transported across the membrane, and in the case where aqueous alkali metal chloride solution is electrolysed the cell liquor comprises an aqueous solution of alkali metal hydroxide.

Where the separator to be used in the electrolytic cell is a microporous diaphragm the nature of the diaphragm will depend on the nature of the electrolyte which is to be electrolysed in the cell. The diaphragm should be resistant to degradation by the electrolyte and by the products of electrolysis and, where an aqueous solution of alkali metal chloride is to be electrolysed, the diaphragm is suitably made of a fluorine-containing polymeric material as such materials are generally resistant to degradation by the chlorine and alkali metal hydroxide produced in the electrolysis. Preferably, the microporous diaphragm is made of polytetrafluoroethylene, although other materials which may be used include, for example, tetrafluoroethylene-hexafluoropropylene copolymers, vinylidene fluoride polymers and copolymers, and fluorinated ethylene-propylene copolymers.

Suitable microporous diaphragms are those described, for example, in UK Pat. No. 1503915 in which there is described a microporous diaphragm of polytetrafluoroethylene having a microstructure of nodes interconnected by fibrils, and in UK Pat. No. 1081046 in which there is described a microporous diaphragm produced by extracting a particulate filler from a sheet of polytetrafluoroethylene. Other suitable microporous diaphragms are described in the art.

Where the separator to be used in the cell is a cation-exchange membrane the nature of the membrane will also depend on the nature of the electrolyte which is to be electrolysed in the cell. The membrane should be resistant to degradation by the electrolyte and by the products of electrolysis and, where an aqueous solution of alkali metal chloride is to be electrolysed, the membrane is suitably made of a fluorine-containing polymeric material containing cation-exchange groups, for example, sulphonic acid, carboxylic acid or phosphonic acid groups, or derivatives thereof, or a mixture of two or more such groups.

Suitable cation-exchange membranes are those described, for example, in UK Pat. Nos. 1184321, 1402920, 1406673, 1455070, 1497748, 1497749, 1518387 and 1531068.

In the electrolytic cell in which the electrode of the invention is installed the individual anode compartments of the cell will be provided with means for feeding electrolyte to the compartments, suitably from a common header, and with means for removing products of electrolysis from the compartments. Similarly, the individual cathode compartments of the cell will be provided with means for removing products of electrolysis from the compartments, and optionally with means for feeding water or other fluid to the compartments, suitably from a common header.

For example, where the cell is to be used in the electrolysis of aqueous alkali metal chloride solution the anode compartments of the cell will be provided with means for feeding the aqueous alkali metal chloride solution to the anode compartments and with means for removing chlorine and optionally with means for removing depleted aqueous alkali metal chloride solution from the anode compartments, and the cathode compartments of the cell will be provided with means for removing hydrogen and cell liquor containing alkali metal hydroxide from the cathode compartments, and optionally, and if necessary, with means for feeding water or dilute alkali metal hydroxide solution to the cathode compartments.

Although it is possible for the means for feeding electrolyte and for removing products of electrolysis to be provided by separate pipes leading to or from each of the respective anode and cathode compartments in the cell such an arrangement may be unnecessarily complicated and cumbersome, particularly in an electrolytic cell of the filter press type which may comprise a large number of such compartments. A preferred type of electrolytic cell is made up of electrodes of the invention in the form of anodes having an active metallic anode portion, electrodes of the invention in the form of cathodes having an active metallic cathode portion, separators optionally mounted on plates of electrically insulating material, and optionally spacers or gaskets of electrically insulating material between the anode and adjacent separator and between the cathode and adjacent separator, the anodes, cathodes, plates and spacers or gaskets, if present, having a plurality of openings therein which in the cell define separate compartments lengthwise of the cell and through which the electrolyte may be fed to the cell, e.g to the anode compartments of the cell, and the products of electrolysis may be removed from the cell, e.g from the anode and cathode compartments of the cell. The compartments lengthwise of the cell may communicate with the anode compartments and cathode compartments of the cell via channels in the electrodes, e.g. in the faces of the electrodes or by channels in the plates or in the spacers or gaskets, e.g in the faces of the spacers or gaskets.

Where the electrolytic cell comprises hydraulically permeable diaphragms there may be two or three openings which define two or three compartments lengthwise of the cell from which electrolyte may be fed to the anode compartments of the cell and through which the products of electrolysis may be removed from anode and cathode compartments of the cell.

Where the electrolytic cell comprises cation permselective membranes there may be four openings which define four compartments lengthwise of the cell from which electrolyte and water or other fluid may be fed respectively to the anode and cathode compartments of the cell and through which the products of electrolysis may be removed from the anode and cathode compartments of the cell.

In the electrolytic cell the compartments lengthwise of the cell which are in communication with the anode compartments of the cell should be insulated electrically from the compartments lengthwise of the cell which are in communication with the cathode compartments of the cell.

The electrical insulation may be achieved in a variety of ways. For example, anodes and cathodes of the cell may each be positioned in and supported by a frame member of an electrically insulating material in which the openings which in the cell form a part of the compartments lengthwise of the cell are defined by openings in the frame member.

If desired, the function of spacer or gasket and support for an anode or cathode may be provided by a suitably shaped single frame member.

Alternatively, the anodes and cathodes of the electrolytic cell may be made in part of electrically insulating material and may be in part metallic. The openings in the electrode which in the cell form a part of the compartments lengthwise of the cell may be formed in the metallic part of the anode or cathode and in a part of the anode or cathode which is made of an electrically insulating material so that the desired electrical insulation of the lengthwise compartments is achieved.

The spacers or gaskets should be made of an electrically insulating material. The electrically insulating material is desirably resistant to the liquors in the cell, and is suitably a fluorine-containing polymeric material, for example, polytetrafluoroethylene, polyvinylidene fluoride or fluorinated ethylene-propylene copolymer. Another suitable material is an EPDM rubber.

The invention has been described with reference to an electrode suitable for use in an electrolytic cell for the electrolysis of alkali metal halide solution. It is to be understood, however, that the electrode may be used in electrolytic cells in which other solutions may be electrolysed, or in other types of electrolytic cells, for example in fuel cells.

Figure 2:
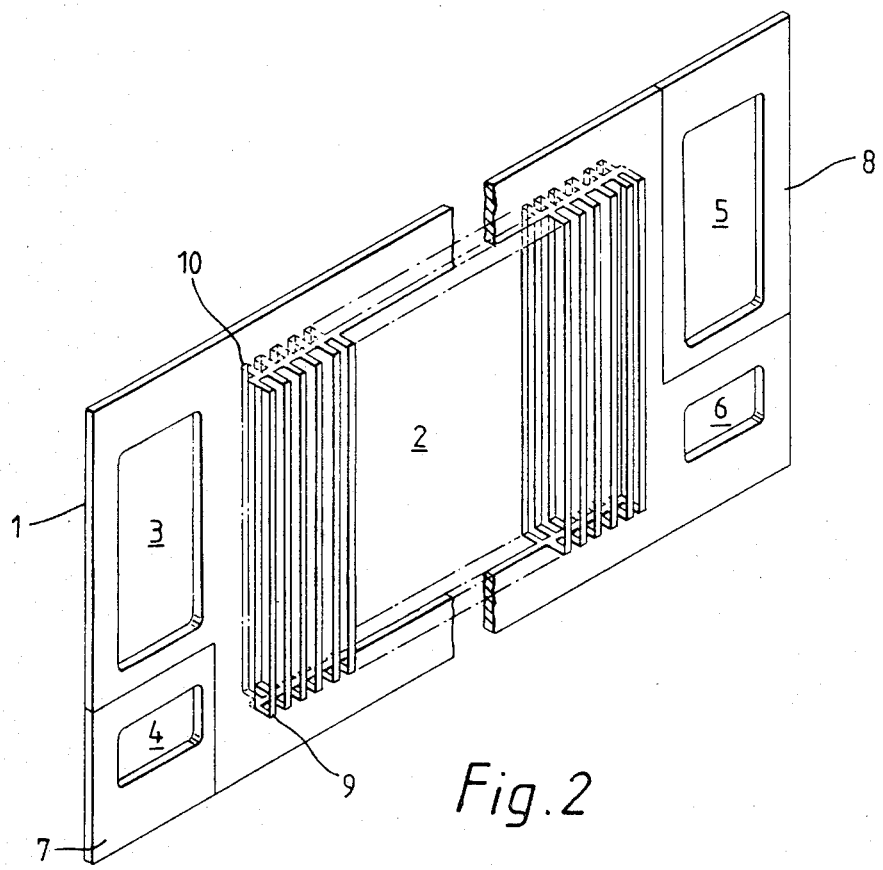
Figure 3:
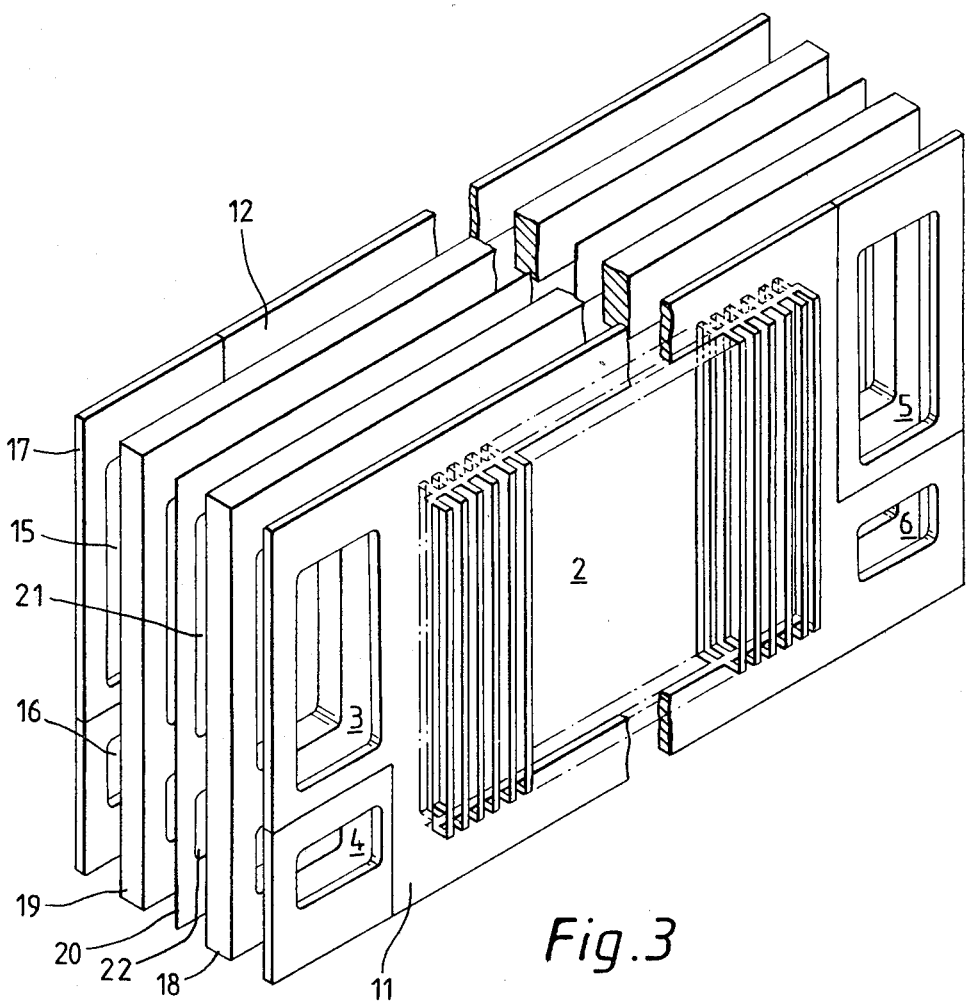

The invention will now be described with the aid of the following drawings in which FIG. 1 is an end view in elevation of an electrode of the invention, FIG. 2 is an isometric view of the electrode of FIG. 1 partially cut away, FIG. 3 is an exploded isometric view, partially cut away, of a part of an electrolytic cell incorporating electrodes of the invention.

Figure 4:
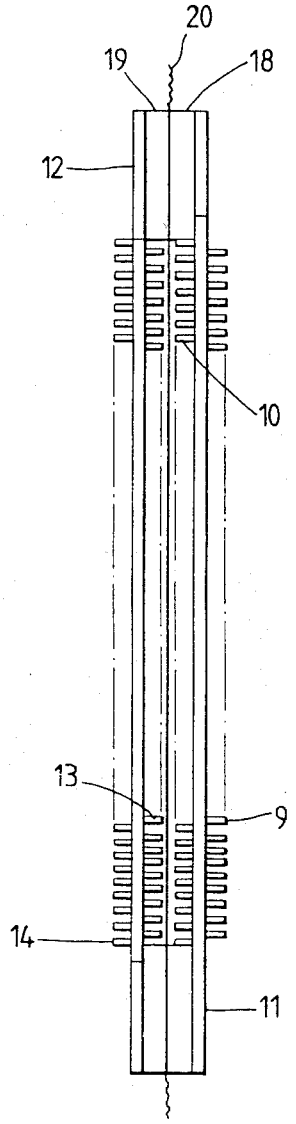
Figure 5:
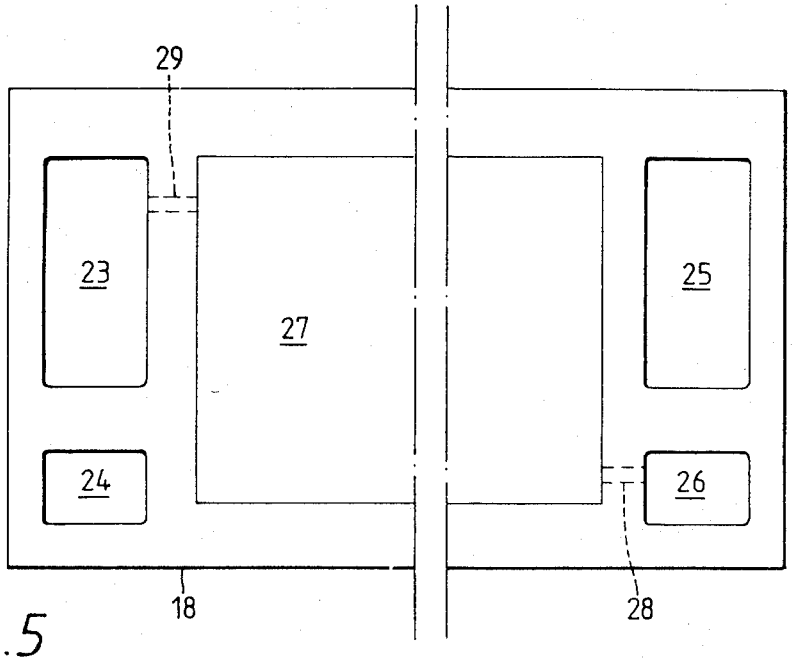
Figure 6:
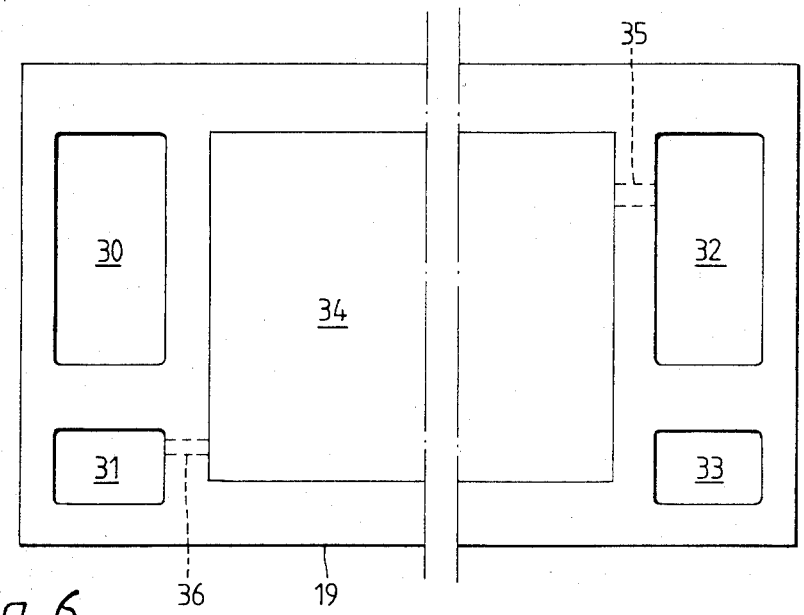

FIG. 4 is a top view of the part of the electrolytic cell of FIG. 3 with the cell in unexploded form, and FIGS. 5 and 6 are views in elevation of gaskets partially cut away incorporated into the parts of the electrolytic cells shown in FIGS. 3 and 4.

Referring to FIGS. 1 and 2 the electrode comprises a planar support member (1) in the form of a frame surrounding a central space (2), and in the sides of the frame a plurality of openings (3,4,5,6) disposed in pairs (3,4) and (5,6) near to opposite edges of the frame. These openings (3,4,5,6), when the electrode is assembled into an electrolytic cell, define compartments lengthwise of the cell through which electrolyte and other fluid, e.g water, may be charged to the electrolytic cell, and through which the products of electrolysis may be removed from the electrolytic cell, as described more specifically hereafter. The support member (1) is constructed in large part of metal except that, in order to electrically insulate the opening (3) from the opening (4) the part (7) of the support member (1) is made of an electrically insulating material, e.g. polytetrafluoroethylene, and in order to electrically insulate the opening (5) from the opening (6) the part (8) of the support member (1) is made of an electrically insulating material, e.g. polytetrafluoroethylene.

The central opening (2) is bridged by a plurality of strips (9) on one side of the frame and a plurality of strips (10) on the other side of the frame. The strips on each side of the support member (1) are vertically disposed, evenly spaced, and parallel to each other. The strips are offset so that the strips (10) on one side of the support member (1) are positioned opposite to a space between two adjacent strips (9) on the other side of the support member (1). The faces of the strips (9) are in a plane parallel to and laterally displaced from the plane of the support member (1), and similarly the faces of the strips (10) are in a plane parallel to and laterally displaced from the plane of the support member (1).

The strips may be attached at their ends to the frame of the support member (1) by any suitable means, for example by welding or brazing. Alternatively the strips may be formed by making a pluralty of substantially parallel slits in a planar support member (1) and displacing a substantial proportion of each of the strips thereby defined in the support member, alternately first to one side and then to the other side of the support member.

The choice of metal for the metallic part of the electrode will depend on the intended use of the electrode, that is whether the electrode is to be used as an anode or a cathode. Where the electrode is to be used as an anode, for example in an electrolytic cell for the electrolysis of aqueous alkali metal halide solution, the metallic part of the electrode is suitably made of titanium. Where the electrode is to be used as a cathode in an electrolytic cell for the electrolysis of aqueous alkali metal halide solution, the metallic part of the electrode is suitably made of iron, e.g. mild steel.

Referring to FIGS. 3 and 4 the part of the electrolytic cell shown comprises an anode (11), as described with reference to FIGS. 1 and 2, and a cathode (12). The cathode (12) is of similar construction to the anode (11) in that it comprises vertically disposed strips (13) on one side of the cathode and vertically disposed strips (14) on the opposite side of the cathode and bridging a central space in the cathode of the same dimensions as the central space (2) in the anode (11). The cathode also comprises four opening (15, 16 two not shown) disposed in pairs near to opposite edges of the cathode and of the same dimensions and corresponding in position to the openings (3,4,5,6) in the anode (11). The cathode (12) differs from the anode (11) in that the part (17), and a part in the cathode diagonally opposite to the part (17) which is not shown, are made of an electrically insulating material, for example polytetrafluoroethylene.

The electrolytic cell also comprises gaskets (18, 19) made of an electrically insulating material, for example EPDM rubber, and a cation exchange membrane (20) positioned between the gaskets (18, 19). The membrane (20) has four openings (21, 22, two not shown) corresponding in position to and of the same dimensions as the openings (3,4,5,6) in the anode (11).

Referring to FIG. 5, the gasket (18) comprises four openings (23, 24, 25, 26) and a central space (27) of the same dimensions as and corresponding in position to, respectively, the openings (3,4,5,6) and the central space (2) in the anode (11). The gasket (18) also has a channel (28) in the wall of the gasket providing communication between the opening (26) and the central space (27), and a channel (29) in the wall of the gasket providing communication between the central space (27) and the opening (23).

Referring to FIG. 6, the gasket (19) comprises four openings (30, 31, 32, 33) and a central space (34) of the same dimensions as and corresponding in position to, respectively, the openings (3,4,5,6) and the central space (2) in the anode (11). The gasket (19) also has a channel (35) in the wall of the gasket providing communication between the central space (34) and the opening (32), and a channel (36) in the wall of the gasket providing communication between the opening (31) and the central space (34).

In order to assemble an electrolytic cell a plurality of anodes, cathodes, membranes and gaskets as shown in FIGS. 3 and 4 are assembled together with suitable end plates, and tightly fastened together, for example by bolting together, in order to prevent leakage of fluids from the electrolytic cell, and the anodes and cathodes are separately connected, for example by suitable conductors, e.g. of copper, respectively to anode and cath-